United States Patent [19]

Kunieda et al.

[11] Patent Number: 4,557,897

[45] Date of Patent: Dec. 10, 1985

[54] METHOD FOR SUPPLYING COLD OR HOT WATER

[75] Inventors: Hiroshi Kunieda, Nishinomiya; Hiroshi Yamamoto, Amagasaki; Yuji Nishkawa, Amagasaki; Yoshihiko Enpuku, Amagasaki, all of Japan

[73] Assignee: The Furukawa Electric Co., Ltd., Tokyo, Japan

[21] Appl. No.: 585,473

[22] Filed: Mar. 2, 1984

[51] Int. Cl.[4] ..... C23F 11/00

[52] U.S. Cl. ..... 422/15; 210/699; 252/396; 422/17

[58] Field of Search ..... 210/698, 699; 252/389.2, 396; 422/17, 18, 15

[56] References Cited

U.S. PATENT DOCUMENTS

| | | | |
|---|---|---|---|
| 2,529,177 | 11/1950 | Nieland et al. | 252/76 |
| 3,019,195 | 1/1962 | Denman et al. | 252/389.2 |
| 4,048,065 | 9/1977 | Suen et al. | 252/389.2 |
| 4,086,181 | 4/1978 | Suen et al. | 252/396 |

FOREIGN PATENT DOCUMENTS

| | | |
|---|---|---|
| 58-42273 | 3/1983 | Japan . |
| 58-115231 | 7/1983 | Japan . |

OTHER PUBLICATIONS

"Influence of Phytin Acid to the Pitting Corrosion of Cupreous Pipes for Supplying Hot Water" by Hiroshi Yamamoto and Hiroshi Kinieda of The Furukawa Electric Co., Ltd. published on May 18, 1983.

*Primary Examiner*—Paul Lieberman
*Assistant Examiner*—Willie J. Thompson
*Attorney, Agent, or Firm*—Armstrong, Nikaido, Marmelstein & Kobovcik

[57] ABSTRACT

A method for treating cold or hot water delivered through copper tubes characterized by dosing the hexaphosphoric acid ester of myo-inositol ($C_6H_{18}O_{24}P_6$) or its salts into the cold or hot water.

4 Claims, No Drawings

METHOD FOR SUPPLYING COLD OR HOT WATER

DETAILED DESCRIPTION OF THE INVENTION

The present invention relates to a method for supplying cold or hot water at hotels, hospitals, mansions and the like, and, in particular, prevention of the pitting corrosion and the occurrence of green staining when copper or copper alloy tubes are used in cold or hot water service.

Recently, copper or copper alloy tubes having an excellent corrosion resistance under circumstances of plain water are widely used to supply cold or hot water at the buildings such as hotels, hospitals, mansions and the like. On the other hand, corresponding to the situations that the demand of tap water increases from year to year and the lack of water is becoming more serious, the external circumstances including the deterioration of water quality grow worse, and the troubles resulting from the corrosion are frequently caused in copper and copper alloy tubes used to supply cold or hot water. The main troubles are the leakage of water due to the pitting corrosion and the occurrence of green staining.

There are no appropriate preventive method for the pitting corrosion up to the present because of the obscurity of an origin. The occurrence of green staining is due to the fact that either a very small quantity of copper ions are dissolved into the supplying cold or hot water and react with soap, dirt, the a secretions of human beings and the like, or substance assuming a green color is formed through the drying and the concentration. Since the dissolving out of a very small quantity of copper ions into the tap water is a phenomenon incapable of being prevented due to a solubility of the metallic materials, no appropriate preventive methods have been developed hitherto. After extensive investigation and research was made on the pitting corrosion in the copper tube for the supply of cold or hot water in view of those described above, it has been noticed that the residual chlorine present in the supplying cold or hot water is a cause of the pitting corrosion in the copper tube, and as a result of further researches, it has been found that the phytic acid ($C_6H_{18}O_{26}P_6$) and its salts are extremely effective to prevent the occurrence of the pitting corrosion and that the substance can also prevent the occurrence of green staining, since it forms a stable chelate compound with a very small quantity of copper ions dissolved out from the copper tube, leading to the development of a method of this invention for supplying cold or hot water, characterized by incorporating a substance which is capable of forming a stable chelate compound with copper ions such as dosing the phytic acid ($C_6H_{18}O_{26}P_6$) and its salts into cold or hot water flowing through the copper tube, thereby the tap water being stored in the receiving tank or the overhead tank and supplied as cold or hot water from said water tank through the copper tube.

Namely, when investigating the pitting corrosion of the copper tube for the supply of cold or hot water, a greenish-blue sulfate lumpy scale, the main component thereof being basic copper sulfate, can be observed inside the surface of the copper tube and the corrosion pit containing $Cu_2O,_1CuCl$, etc. is present under it. This indicates, from the viewpoint of electrochemistry that the potential of the copper tube shifted to the nobler direction during the supply of cold or hot water compared with the normal potential. Now, since the water quality in the source of water supply has to deteriorated in Japan recently, the dosage of chlorine at the water-purifying plant is being increased for the maintenance of the water quality. Also, at the building such as hotels, hospitals, mansions and the like, the tap water thereby being stored in the receiving tank or the overhead tank for the dual supply of cold and hot water and supplied to each room or each section, the secondary sterilization with chlorine is apt to be done in the receiving tank or the overhead tank because of the sanitary problems. Under such situations as these, the probability that the copper tube in cold or hot water service is exposed to the residual chlorine becomes higher, and if the residual chlorine is present in the supplying cold or hot water, it would oxidize copper ions dissolved out from the copper tube, since it is a strong oxidizing agent.

Oxidized copper ions deposited on the inside surface of the copper tubes and make the potential of the copper tubes shift to the nobler direction. Since anions such as $Ca^-$, $SO_4^{2-}$, etc. are present in the supplying cold or hot water, if the potential of the copper tubes shifts to the nobler direction due to the presence of residual chlorine, the pitting corrosion as a form of corrosion described above would occur. It is impossible in practice to remove anions such as $Cl^-$, $SO_4^{2-}$, etc. present in the supplying cold or hot water, and the removal of residual chlorine also poses the sanitary problems. Accordingly, in order to prevent the pitting corrosion occurring in the process as mentioned above, it is necessary to suppress a phenomenon that the potential of the copper tubes shifts to the nobler direction under circumstances of the presence of $Cl^-$, $SO_4^{2-}$, residual chlorine, etc. In other words, under circumstances of the supply of cold or hot watering being present, $Cl^-$, $SO_4^{2-}$ and residual chlorine therein, the suppression of the oxidation of copper ions dissolved out and their deposition on the surface of the copper tubes as oxides may be enough. As a result of further investigations based on these views, it was possible to convert copper ions dissolved out to a stable chelate compound and to suppress the subsequent reaction process by dosing the phytic acid ($C_6H_{18}O_{24}P_6$) and/or its salts into cold or hot water flowing through the copper tube. If this substance is dosed into cold or hot water, copper ions dissolved out form a stable chelate compound and the subsequent reaction process is suppressed resulting in the prevention of the occurrence of pitting corrosion, even if $Cl^-$, $SO_4^{2-}$, and residual chlorine may be present in the supplying cold or hot water. Furthermore, since copper ions dissolved out form stable chelate compounds and the subsequent chemical reaction is suppressed through the dosage of this substance, the occurrence of green staining resulting from the reaction of copper ions with soap or with dirt which is a secretion of human being can also be prevented.

In particular, it is convenient to use an aqueous solution of phytic acid at a concentration of about 50% as it is, or after diluting to about 20 to 0.1% properly. Phytic acid means the hexaphosphoric acid ester of myo-inositol ($C_6H_{18}O_{24}P_6$) which is an organic phosphoric acid ester widely distributed in the vegetable kingdom and is extracted from the rice bran in most cases.

In the invention, the reason why the concentration is confined within a range of 0.01 to 1 mg/l is as follows. Namely, if the concentration is lower than 0.01 mg/l, there is a danger to cause the pitting corrosion, and if the concentration is higher than 1 mg/l, there is an undesireably high concentratin of phosphorous in the effluent, which is environmentally undesireable, as well as an economical loss.

On enforcement of the invention, the amount of phytic acid or its salts is sufficient if present about 0.01 to 1 mg/l in the supplying cold or hot water.

This is due to the fact that since $Cu^{2+}$ dissolved in the supplying cold or hot water is at most about 1 mg/l, the occurrence of green staining as well as the pitting corrosion can be depressed sufficiently by dosing this substance to form a chelate compound with this in equivalent amount of less than 1 mg/l. Moreover, when dissolved $Cu^{2+}$ is absent in the supplying cold or hot water, the amount of substances is sufficient if present over 0.01 mg/l for the purpose of the prevention of pitting-corrosion alone. The dosage of substances in excess of 1 mg/l, is not advantageous in come cases because cloudiness.

In the following the invention will be explained using the examples.

EXAMPLE 1

Two corrosion testing devices, fitted with a circulating pump, a hot water-storage tank providing a heating unit and an injection apparatus for sodium hypochlorite solution, were used. To each of these devices, phosphorus-deoxidized copper tube having a diameter of 22.23 mm, a wall thickness of 0.81 mm and a length of 500 mm was fitted up, and the loop tests were carried out. The circulating water was replaced with fresh tap water once a day and heated to 60° C. maintaining the concentration of the residual chlorine within 1 to 2 mg/l. To one device of the two, 5 mg/l of phytic acid were added into the circulating water. Loop tests were continued for a month in this way. As a result, greenish blue lumpy scale having basic copper sulfate as a main component was observed at many places on the inside surface of the phosphorus-dioxidized copper tube of the device without the addition of phytic acid, and the corrosion pits having a depth of about 0.1 mm were present under it. On the contrary, no corrosion was observed on the inside surface of the phosphorus deoxidized copper tube of the device within the addition of phytic acid.

Besides, the potential of the phosphorus-deoxidized copper tube of each device was measured employing saturated calomel electrode as a standard. The potential rose to +200 mV in the case of the device without the addition of phytic acid, whereas it did not exceed +50 mV in the cases of the device within the addition of phytic acid.

EXAMPLE 2

One hundred ml of tap water were taken in a beaker and copper sulfate solution was added to make $Cu^{2+}$ present. This solution was filtered after adjustment of the pH with caustic soda. When pH was adjusted to 8, substance assuming a blue color was detected on the filter paper in the case of the addition of more than 2 mg/l of $Cu^{2+}$. Also, when pH was adjusted to 9 or 10, substance assuming a blue color was detected similarly on the filter paper in the case of the addition of more than 1.5 mg/l of $Cu^{2+}$.

On the contrary to these, when 5 mg/l of phytic acid was added before the addition of $Cu^{2+}$, substance assuming a blue color was never detected provided $Cu^{2+}$ added was less than 5 mg/l, even if pH was adjusted to 8, 9 or 10.

EXAMPLE 3

A leakage accident has occurred on the fourth year after use at a hotel used copper tubes in hot water service. When inspecting the tubes drawn out at ten and several places, the pitting corrosion occurred inside surface of all tubes and yet a part of corrosion pits pierced through outside of the tube. New copper tubes were fitted up at the drawn out portion, and phytic acid was dosed every day so as to amount 1 mg/l of the supplying water into the receiving tank as a countermeasure to the corrosion. Apart of copper tubes fitted up newly was inspected after one year, but the occurrence of the pitting corrosion was not recognized. Thereafter, no leakage accident is caused at this hotel.

EXAMPLE 4

A phenomenon that the curtain in the bathroom tinted blue on the sixth month after use was recognized at a hotel which used copper tubes in hot water service. The pH of the tap water in the receiving tank at the hotel was around 6.5 at that time. Taking 500 ml of the supplying water and filtering after the adjustment of pH to 9 with caustic soda, a substance assuming a blue color was detected on the filter paper. Thereupon, phytic acid 1 mg/l was added every day into the supplying water in the receiving tank as a prevention countermeasure to the occurrence of green staining. On the seventh day from the beginning of the addition of phytic acid, 500 ml of the supplying water for the same bathroom were taken and filtered after the adjustment of pH to 9 with caustic soda. Substance assuming a green staining was never detected this time. Moreover, no problems about blue color occur at the hotel thereafter.

EXAMPLE 5

Six corrosion testing devices fitted with a circulation pump, the hot water-storage tank provided a heating unit and an injection apparatus for sodium hypochlorite solution, were used. To each of these devices, phosphorus-deoxidized copper tube having a diameter of 22.23 mm, a thickness of 0.81 mm and a length of 500 mm was fitted up, and the loop tests were carried out. The circulating water of all six devices were replaced with fresh tap water once a day and heated to 60° C. maintaining the concentration of the residual chlorine within a range of 0.5 to 1.0 mg/l. To five devices of six, 0.005 mg/l, 0.01 mg/l, 0.1 mg/l, 1.0 mg/l and 2.0 mg/l of phytic acid were added respectively on every replacement of the circulating water. Loop tests were continued for three months in this way, and the potential of phosphorus-deoxidized copper tube, the state of the occurrence of pitting corrosion and the turbidity of the circulating water were investigated.

Results are shown in Table 1.

| Concentration of [phytinic] phytic acid (mg/l) | Depth of pits [corrosion] (mm) | [Natural potential] Potential (mV vs. SCE) | State of turbidity of circulating water |
|---|---|---|---|
| 0 | 0.1 | +200 | Transparent |
| 0.005 | 0.006 | +150 | " |
| 0.01 | 0.01 | +70 | " |
| 0.1 | <0.01 | +50 | " |
| 1.0 | <0.01 | +50 | " |

-continued

| Concentration of [phytinic] phytic acid (mg/l) | Depth of pits [corrosion] (mm) | [Natural potential] Potential (mV vs. SCE) | State of turbidity of circulating water |
|---|---|---|---|
| 2.0 | <0.01 | +40 | Cloudy |

It is demonstrated that the pitting corrosion occurs when the potential exceeds +150 mV (SCE). Moreover, it is also made clear that the residual chlorine originating from the chlorine-containing disinfectants and sterilizers used for the disinfection and the sterilization of the tap water plays an important role to raise the potential of copper tube to 150 mV (SCE). From the results listed above, it can be seen that the addition of phytic acid is preferable within a concentration range of 0.01 to 1 mg/l.

As described above, the present invention provides remarkable effects in that the pitting corrosion of the copper tube is prevented without shift of the potential of the copper tube to the nobler direction, even if the residual chlorine is present in the supplying cold and hot water, and that the formation of a substance assuming a blue-green color resulting from the reaction of copper ions with soap or dirt, or secretions of human beings can be prevented simultaneously, because of the conversion of a very small quantity of copper ions dissolved out to a stable chelate compound.

What is claimed is:

1. A method of conditioning hot or cold water delivered through a copper pipe or tubing system comprising the addition of phytic acid or its water soluble salts to the hot or cold water flowing through said copper pipe or tubing system.

2. The method for conditioning hot or cold water recited in claim 1, wherein phytic acid or its water soluble salts are added into the hot or cold water in a receiving tank, an overhead tank or a tank storing hot water.

3. The method for conditioning hot or cold water recited in claim 1, wherein phytic acid or its water soluble salts are added to the hot or cold water in an amount of 0.01 to 1.0 mg/liter based on the weight of phytic ion.

4. The method for conditioning hot or cold water recited in claim 1, wherein phytic acid or its water soluble salts are added in an amount capable of depressing the electrochemical potential of the copper to not more than +150 mV (SCE).

* * * * *